US005392736A

United States Patent [19]

Dietz et al.

[11] Patent Number: 5,392,736

[45] Date of Patent: Feb. 28, 1995

[54] FLUDIZED BED COMBUSTION SYSTEM AND PROCESS FOR OPERATING SAME

[75] Inventors: David H. Dietz, Hampton; Walter R. Campbell, Union, both of N.J.

[73] Assignee: Foster Wheeler Energy Corporation, Clinton, N.J.

[21] Appl. No.: 173,224

[22] Filed: Dec. 27, 1993

[51] Int. Cl.[6] ..... F22B 1/00

[52] U.S. Cl. ..... 122/4 D; 110/245; 110/263; 110/346

[58] Field of Search ..... 110/245, 346, 347, 263; 122/4 D; 422/139

[56] References Cited

U.S. PATENT DOCUMENTS

| | | | |
|---|---|---|---|
| 4,308,810 | 1/1982 | Taylor . | |
| 4,565,138 | 1/1986 | Ueda et al. . | |
| 4,572,082 | 2/1986 | Ueda et al. . | |
| 4,708,067 | 11/1987 | Narisoko et al. | 110/245 |
| 4,744,312 | 5/1988 | Narisolo et al. . | |
| 4,854,249 | 8/1989 | Khinkis et al. . | |
| 4,860,693 | 8/1989 | Jarvstrat . | |
| 4,915,061 | 4/1990 | Garcia-Mallol . | |
| 4,951,612 | 8/1990 | Gorzegno . | |
| 4,962,711 | 10/1990 | Yamauchi et al. | 110/347 |
| 5,003,931 | 4/1991 | Huschauer . | |
| 5,020,456 | 6/1991 | Khinkis et al. . | |
| 5,054,436 | 10/1991 | Dietz | 122/4 D |
| 5,078,100 | 1/1992 | Huschauer et al. . | |
| 5,095,854 | 3/1992 | Dietz . | |
| 5,105,747 | 4/1992 | Khinkis et al. . | |
| 5,140,950 | 8/1992 | Abdulally . | |

*Primary Examiner*—Edward G. Favors
*Attorney, Agent, or Firm*—Marvin A. Naigur

[57] ABSTRACT

A fluidized bed combustion system and process is disclosed, in which full load stoichiometry is maintained at lower loads. The system and process includes an enclosure and a partition disposed in the enclosure to define a furnace section and an overfire air plenum section. A bed of combustible particulate material is formed in the furnace section and air is passed into the bed in quantities sufficient to fluidize the material and insufficient to completely combust the material. Overfire air is passed into the overfire air plenum, through control dampers in the partition and into the furnace section in quantities sufficient to completely combust the material.

15 Claims, 1 Drawing Sheet

FLUDIZED BED COMBUSTION SYSTEM AND PROCESS FOR OPERATING SAME

BACKGROUND OF THE INVENTION

This invention relates to a fluidized bed combustion system and a process of operating same and, more particularly, to such a system and process in which dampers control upper furnace solids loading while maintaining full load stoichiometry at lower loads.

Fluidized bed combustion systems are well known and include a furnace section in which air is passed through a bed of particulate material, including a fossil fuel, such as coal, and an adsorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxide emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The high external solids recycling is achieved by disposing a cyclone separator at the furnace section outlet to receive the flue gases and the solids entrained thereby from the fluidized bed. The solids are separated from the flue gases in the separator and the flue gases are passed to a heat recovery area while the solids are recycled back to the furnace through a seal pot or seal valve. All of the fuel is combusted and the heat of combustion is absorbed by water/steam-cooled tube surfaces forming the interior boundary of the furnace section and the heat recovery area. The recycling improves the efficiency of the separator, and the resulting increase in the efficient use of sulfur adsorbent and fuel residence times reduces the adsorbent and fuel consumption.

In these type of arrangements, the amount of primary air supplied to the fluidized bed must be limited to that below the ideal amount for complete combustion in order to reduce nitrous oxide (NOX) emissions. Thus, overfire or secondary air is injected above the fluidized bed in sufficient quantities to maintain a ratio of primary air to secondary air to insure complete combustion.

However, problems arise in maintaining this requisite ratio of primary air to secondary air during low load conditions. More particularly, as load is reduced the solids circulation, or loading is also reduced which reduces the residence time of the solids and the capture of sulfur oxides ($SO_2$). Our solution to this is to increase the amount of primary air. However, this destroys the requisite ratio of primary air to secondary air, resulting in increased NOX emissions.

Also in these types of fluidized beds, particulate fuel of a size extending over a relative wide range is utilized. For example, a typical bed will contain relatively coarse particles of 350–850 microns in diameter which tend to form a dense bed in the lower furnace, and relatively fine particles of 75–225 microns in diameter which are entrained by the flue gases and recycled. This tends to reduce coarse particle entrainment and cause instability in the dense bed of coarse materials resulting in sluging or choking of the bed material and pressure fluctuations in the lower furnace.

SUMMARY OF THE INVENTION

Accordingly, it is an object of the present invention to provide a system and process in which the requisite ratio of primary air to secondary air is maintained during low load conditions, thus insuring that NOX emissions and $SO_2$ capture are the same as during full load conditions.

It is a further object of the present invention to provide a system and method of the above type in which the solids circulation, or loading is not reduced to unacceptable levels.

It is a still further object of the present invention to provide a system and method of the above type in which the introduction of secondary or overfire air is precisely controlled to maintain the requisite ratio of primary air to secondary air to reduce NOX emissions while allowing for sufficient solids circulation and entrainment to insure adequate capture of $SO_2$.

It is a further object of the present invention to provide a system and process of the above type in which stoichiometry is maintained at lower loads without a significant reduction in solids loading.

It is a further object of the present invention to provide a system and process of the above type in which lower furnace sluging or choking is reduced.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 2:
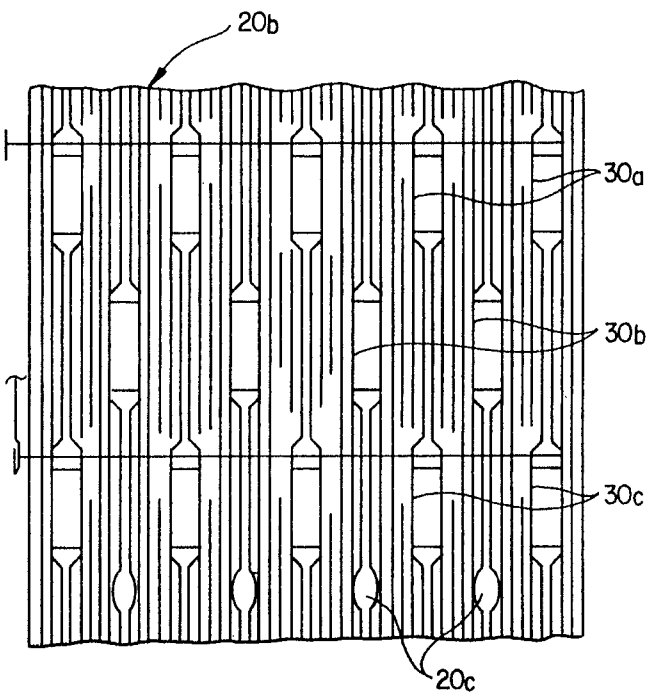
FIG. 2 is an enlarged cross-sectional view taken along the line 2—2 of FIG. 1.

The drawings depict the fluidized bed combustion system of the present invention used for the generation of steam and including an upright water-cooled enclosure, referred to in general by the reference numeral 10, having a front wall 12, a rear wall 14, and two sidewalls. For clarity only walls 12 and 14 are shown. The walls of the enclosure 10 are formed by a plurality of tubes interconnected by elongated fins to form a contiguous, airtight structure in a conventional manner. The upper portion of the enclosure 10 is closed by a roof 16 and the lower portion includes a floor 18.

A partition 20 is disposed in the enclosure 10 and extends between the front wall 12 and the rear wall 14.

The partition 20 is formed by a plurality of finned tubes bent inwardly from the rear wall 14 and plates (not shown) are inserted between the bent tubes to form an air-tight connection along their lengths. The partition 20 includes a vertical portion 20*a* extending from the floor 18 and parallel to the wall 12, and an angled portion 20*b* extending from the upper end of the vertical portion to the rear wall 14.

A second partition 22 is disposed beneath the partition 20 and is also formed by bending a plurality of tubes out of the vertical plane of the rear wall 14. The partition 22 consists of three portions. The first portion 22*a* extends up from the floor 18 parallel to, and spaced from, the vertical partition 20*a*. The second portion 22*b* extends from the top of the vertical portion 22*a* and is angled towards and abuts the intersection of the partitions 20*a* and 20*b*. The third portion 22*c* extends between the upper portion of 22*b* and the rear wall 14.

Figure 1:
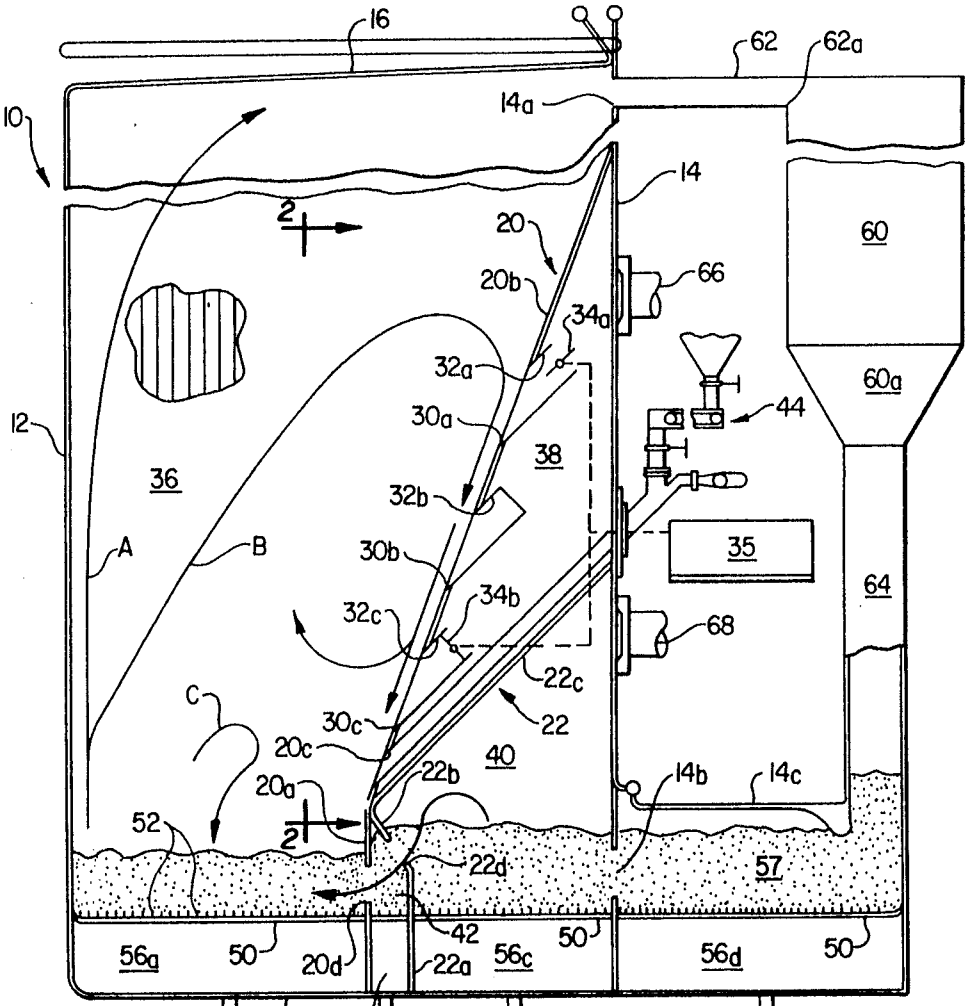
FIG. 1 is a schematic representation depicting the system of the present invention.

As shown in FIGS. 1 and 2, an array of three levels of openings 30*a*, 30*b*, and 30*c* are provided in the angled partition 20*b*. The center openings 30*b* are at a staggered pitch with respect to the openings 30*a* and 30*c*. A series of ducts 32*a*, 32*b*, and 32*c* register with the openings 30*a*, 30*b*, and 30*c*, respectively. A plurality of dampers 34*a* are disposed within the ducts 32*a* and a plurality of dampers 34*b* are disposed within the ducts 32*c*. The dampers 34*a* and 34*b* are mechanically linked by a common damper control mechanism 35 in a conventional manner and the operation of the dampers 34*a* and 34*b*, and the control mechanism 35 will be discussed later.

The enclosure 10 is divided into a furnace section 36, an overfire or secondary air plenum 38, and a recycle section 40 by the partitions 20 and 22, with the walls 20*a*, 22*a*, and 22*b* defining an overflow section 42 which will be described in detail.

A coal feeder system 44 is provided adjacent to and extends through the rear wall 14. The coal feeder system 44 is supported by the angled partition 22*c* and registers with openings 20*c* in the angled partition 20*b* for introducing particulate material containing fuel into the furnace 36. Because the feeder system 44 operates in a conventional manner to spread the fuel into the lower portion of the furnace section 36, it will not be described in any further detail. It is understood that a particulate adsorbent material can also be introduced into the furnace section 36 for absorbing the sulfur generated as a result of the combustion of the fuel. This adsorbent material may be introduced through the feeder system 44 or independently through openings in any of the enclosure walls (not shown).

A water cooled plate 50 extends across the lower portion of the enclosure 10. A plurality of vertically extending air distributor nozzles 52 are mounted in corresponding openings formed in the plate 50. The plate 50 is spaced from the floor 18 and together with walls 12, 20*a*, 22*a*, and 14 define air plenums 56*a*–56*c*, respectively. The floor 18 and the plate 50 extend beyond the rear wall 14 to form an air plenum 56*d*. A horizontal plate 14*c* extends from the rear wall 14 in a spaced relationship to the plate 50 to define an inlet conduit 57. The air plenums 56*a*–56*d* are adapted to receive air from external sources (not shown) via conduits 58*a*–58*d*, respectively, and selectively distribute the air through the nozzles 52 as needed.

The particulate fuel and adsorbent material (hereinafter termed "solids") in the furnace section 36 is fluidized by the air from the plenum 56*a* as the air passes upwardly through the plate 50. Each nozzle 52 is of a conventional design and, as such, includes a control device to enable the velocity of the air passing therethrough to be controlled. This air promotes the combustion of the fuel in the solids and the resulting mixture of combustion gases and the air (hereinafter termed "flue gases") rises in the furnace section 36 by forced convection and entrains a portion of the solids to form a column of decreasing solids density in the furnace section to a given elevation, above which the density remains substantially constant.

Air is selectively introduced into the overflow section 42, the recycle section 40, and the inlet conduit 57, via the coresponding, nozzles 52 as described in U.S. Pat. No. 5,054,436, assigned to the instant applicant.

A conventional cyclone separator 60 extends adjacent to the enclosure 10 and is connected thereto via a duct 62. The duct 62 extends from an outlet opening 14*a* provided in the rear wall 14 of the enclosure 10 to an inlet 62*a* provided through the separator wall. A hopper portion 60*a* extends downwardly from the separator 60.

The separator 60 receives the flue gases and the entrained solids from the furnace section 36 in a manner to be described and operates in a conventional manner to disengage the solids from the flue gases due to the centrifugal forces created in the separator.

The separated solids in the separator 60 pass downwardly, by gravity, into the hopper portion 60*a* from which they pass, into and through a dipleg 64 and into the inlet conduit 57. The separated solids then pass from the inlet conduit 57 into the recycle section 40, through an opening 14*b* provided in the lower portion of the rear wall 14. The solids then pass to the overflow chamber 42 via an opening 22*d* provided in the partition 22*b* and then to the furnace 36 through an opening 20*d* provided in the partition 20*a*. The actual process of recycling the material is described in the above-identified patent.

A pair of vertically spaced overfire air ducts 66 and 68 (FIG. 1) register with openings in the rear wall 14 for introducing overfire or secondary air into the air plenum section 38 and the recycle section 40, respectively. Although not clear from the drawing, it is understood that the tubes forming the partition 22*c* have no fins so that overfire or secondary air from the duct 68 can pass into the plenum 38.

It is understood that a steam drum (not shown) is located above the enclosure 10 and a plurality of headers (not shown) are disposed at the ends of the various walls and partitions described above. Also, a plurality of downcomers, pipes, risers, headers etc. are utilized to establish a steam and water flow circuit.

In operation, the solids are introduced into the furnace section 36 through the feeder system 44, via the openings 20*c*. Alternately, adsorbents may also be introduced independently through openings (not shown) in the enclosure walls. Air from an external source is introduced into the plenum 56*a* extending below the furnace section 36. The air passes through the nozzles 52 disposed in the furnace section 36 at a sufficient quantity and velocity to fluidize the solids in the latter section and form a circulating fluidized bed as described above. Each nozzle 52 is adjusted so that the velocity of the lair discharged therefrom increases from right-to-left as viewed in FIG. 1, i.e., the nozzles closest to the wall 12 discharge air at a relatively high velocity while the nozzles closest to the vertical partition 20*a* discharge air at a relatively low velocity.

A lightoff burner (not shown), or the like, is provided to ignite the fuel material in the solids, and thereafter the fuel material is self-combusted by the heat in the furnace section 36. Thus, the flue gases pass upwardly through the furnace section 36 and entrain a majority of the solids. The quantity of the air introduced, via the air plenum 56*a*, through the nozzles 52 and into the interior of the furnace section 36 is established in accordance with the size of the solids so that a circulating fluidized bed is formed, i.e., the solids are fluidized to an extent that substantial entrainment is achieved. This occurs in the upper portion of the furnace section 36 and in that area of the lower portion of furnace section closer to the front wall 12, while a relatively dense bed of course material is formed in the lower portion of the furnace section 36. The flue gases passing from the latter area into the upper portion of the furnace section 36, as shown by the flow arrow A, are substantially saturated with solids. However, in that area of the furnace section 36 closer to the partition 20*a*, some of the relatively course solids disengage from the flue gases due to the relatively low discharge velocities of the nozzles 52 in the latter area as shown by the flow arrows B and C. A large portion of the disengaged solids fall on the angled partition wall section 20*b* with the greatest concentration near the lower portion of the partition and slide back into the dense bed in the lower portion of the furnace section 36 where they mix with the solids returning to the furnace section 36 from the recycle section 40 as described.

The quantity of air introduced into the furnace section 36 through the nozzles 52 in the above manner is controlled so that it is less than that required for complete combustion of the fuel particles. Overfire or secondary air is supplied by the ducts 66 and 68 to the plenum 38 from which the air passes into the furnace section 36 via the ducts 32*a*, 32*b*, and 32*c*, under the control of the dampers 34*a* and 34*b*. Thus, overfire air is supplied in sufficient controlled quantities to complete combustion and maintain optimum stoichiometry and upper furnace loading. The upper furnace loading is controlled by controlling the position of the upper and lower dampers, 34*a* and 34*b*. As the furnace load is reduced the positions of the upper and lower dampers are adjusted to maintain the desired upper furnace loading with respect to furnace load.

The saturated flue gases in the upper portion of the furnace section 36 exit into the duct 62 and pass into the cyclone separator 60 where the solids are separated from the flue gases. The separated solids pass from the separator 60 through the dipleg 64 and are recycled, via the section 40 to the furnace section 36.

The following advantages are achieved by the process and system of the present invention:

1. Because the overfire air is discharged, via the ducts 32*a*, 32*b*, and 32*c* through the angled partition section 20*b*, which, in effect, is located near the center of the enclosure 10, the mixing of the overfire air, the primary air from the nozzle 52 and the fuel particles, is enhanced resulting in increased combustion of the fuel particles.

2. Air is introduced into the plenums 56*b*–56*d* in sufficient amounts to maintain a fluidized state to insure flow from the inlet conduit 57 to the furnace section 36.

3. The dampers 34*a* and 34*b* allow the furnace to achieve the same NOX emissions performance at part load conditions as at full load conditions.

4. The angled partition wall section 20*b* provides a "return slide" for the disengaged course material which enhances mixing and avoids choking of the circulating solids.

5. The introduction of secondary or overfire air from the plenum 38 is precisely controlled by the dampers 34*a* and 34*b* to maintain the requisite ratio of primary air to secondary air. Thus, reducing NOX emissions while allowing for sufficient solids circulation and entrainment to insure adequate capture of $SO_2$.

6. Stoichiometry is maintained at lower loads by reducing the amount of primary air introduced into the furnace 36 through the nozzles 52 and increasing the amount of overfire air flowing through the dampers 34*a* and 34*b* and the partition 20*b*.

It is understood that several variations can be made in the foregoing without departing from the scope of the present invention. Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system comprising:

an enclosure;

a partition disposed in said enclosure to define a furnace section and an overfire air plenum section, said partition having a plurality of openings and a corresponding plurality of ducts registering with said openings;

a bed of combustible particulate material formed in said furnace section;

means for passing air into said bed in quantities sufficient to fluidize said material and insufficient to completely combust said material;

means for passing overfire air into said overfire air plenum, through said ducts and into said furnace section in quantities sufficient to completely combust said material; and a damper associated with at least one of said plurality of ducts for regulating the flow of said overfire air into said furnace section.

2. The system of claim 1 wherein said means for passing overfire air comprises a plurality of spaced overfire air ducts registering with said enclosure.

3. The system of claim 2 further comprising a second partition disposed within said overfire air plenum to define a recycle section.

4. The system of claim 3 further comprising a separating section for receiving a mixture of flue gases and entrained particulate material from said furnace section and separating said entrained particulate material from said flue gases.

5. The system of claim 4 further comprising means for passing said separated material from said separating section to said recycle section and from said recycle section back to said furnace section.

6. The system of claim 5 further comprising means for fluidizing said recycle section.

7. The system of claim 6 further comprising means for introducing air across said furnace section at varying velocities to induce the flow of said separated material from said recycle section to said furnace section.

8. The system of claim 7 further comprising openings formed in said partitions for permitting said separated solids to pass from said recycle section to said furnace section.

9. The system of claim 8 wherein at least a portion of the walls of said enclosure are formed by tubes, and further comprising fluid flow circuit means for passing fluid through said tubes to transfer heat generated in said furnace section to said fluid.

10. The system of claim 9 wherein said flow circuit means further comprises means for passing said fluid in a heat exchange relation to the separated material in said recycle section to transfer heat from said separated material to said fluid to control the temperature of the separated material passed from said heat exchange compartment to said furnace section.

11. A fluidized bed combustion process comprising the steps of:

supporting a bed of combustible material in a furnace section;

passing air into said bed in quantities sufficient to fluidized said material and insufficient to completely combust said material;

passing overfire air into an overfire air plenum, through a plurality of ducts, and into said furnace in quantities sufficient to completely combust said material; and regulating the passage of said overfire air through said ducts and into said furnace section.

12. The process of claim 11 further comprising the steps of:

discharging a mixture of flue gases and entrained material from said furnace section;

separating said entrained material from said flue gases;

passing said separated flue gases to a heat recovery section;

passing said separated material into and through said recycle section; and varying the velocities of said fluidizing air along said different locations so that said separated material is drawn from said recycle section back into said furnace section.

13. The process of claim 12 wherein said separated material passes from said recycle section into an area of said furnace section adjacent said recycle section and wherein said step of varying comprises the step of fluidizing said material in said area of said furnace section at a lower velocity than the velocity of said air in the remaining portion of said furnace section to cause said separated material to flow from said recycle section to said furnace section.

14. The process of claim 11 wherein the velocity of said fluidizing air introduced to said furnace section progressively increases in a direction from said area across said furnace section to cause said separated material to flow from said recycle section to said area of said furnace section.

15. A fluidized bed combustion process comprising the steps of:

supporting a bed of combustible material in a furnace section;

passing primary air into said bed in quantities sufficient to fluidized said material and insufficient to completely combust said material;

passing secondary air into an overtired air plenum, through a plurality of ducts, and into said furnace section;

establishing a predetermined ratio of primary air to secondary air so that said material is completely combusted;

discharging a mixture of flue gases and entrained material from said furnace section;

separating said entrained material from said flue gases;

circulating said separated material back to said furnace section;

operating said furnace at relative low loads whereby said circulation is reduced; and regulating the flow of secondary air through said ducts and into said furnace section in a manner so that, at said relatively low loads, said ratio is maintained while said reduction is less than it would be without said step of regulating.

* * * * *

UNITED STATES PATENT AND TRADEMARK OFFICE

CERTIFICATE OF CORRECTION

PATENT NO. : 5,392,736

DATED : February 28, 1995

INVENTOR(S) : Dietz et al.

It is certified that error appears in the above-indentified patent and that said Letters Patent is hereby corrected as shown below:

Column 4, line 63, "lair" should be --air-- .

Signed and Sealed this

First Day of August, 1995

*Attest:*

*Attesting Officer*

BRUCE LEHMAN

*Commissioner of Patents and Trademarks*